United States Patent [19]

Kohl

[11] 4,139,996

[45] Feb. 20, 1979

[54] SHED FORMING WARP KNITTING MACHINE WITH WEFT INSERTERS

[75] Inventor: Karl Kohl, Obertshausen, Fed. Rep. of Germany

[73] Assignee: Karl Mayer Textilmaschinenfabrik GmbH, Obertshausen, Fed. Rep. of Germany

[21] Appl. No.: 877,600

[22] Filed: Feb. 14, 1978

[30] Foreign Application Priority Data

Feb. 18, 1977 [DE] Fed. Rep. of Germany ..... 2706941

[51] Int. Cl.[2] ..... D04B 23/00

[52] U.S. Cl. ..... 66/207

[58] Field of Search ..... 66/203, 207, 84 A

[56] References Cited

U.S. PATENT DOCUMENTS 3,403,536 10/1968 Inabi ..... 66/207

FOREIGN PATENT DOCUMENTS 1585148 7/1970 Fed. Rep. of Germany ..... 66/207

*Primary Examiner*—Ronald Feldbaum

*Attorney, Agent, or Firm*—Omri M. Behr

[57] ABSTRACT

A warp knitting machine produces an unusual effect by including a weft thread inserting device capable of operating over a relatively large number of needles eliminating the chain stitches which normally occur at narrow intervals.

6 Claims, 5 Drawing Figures

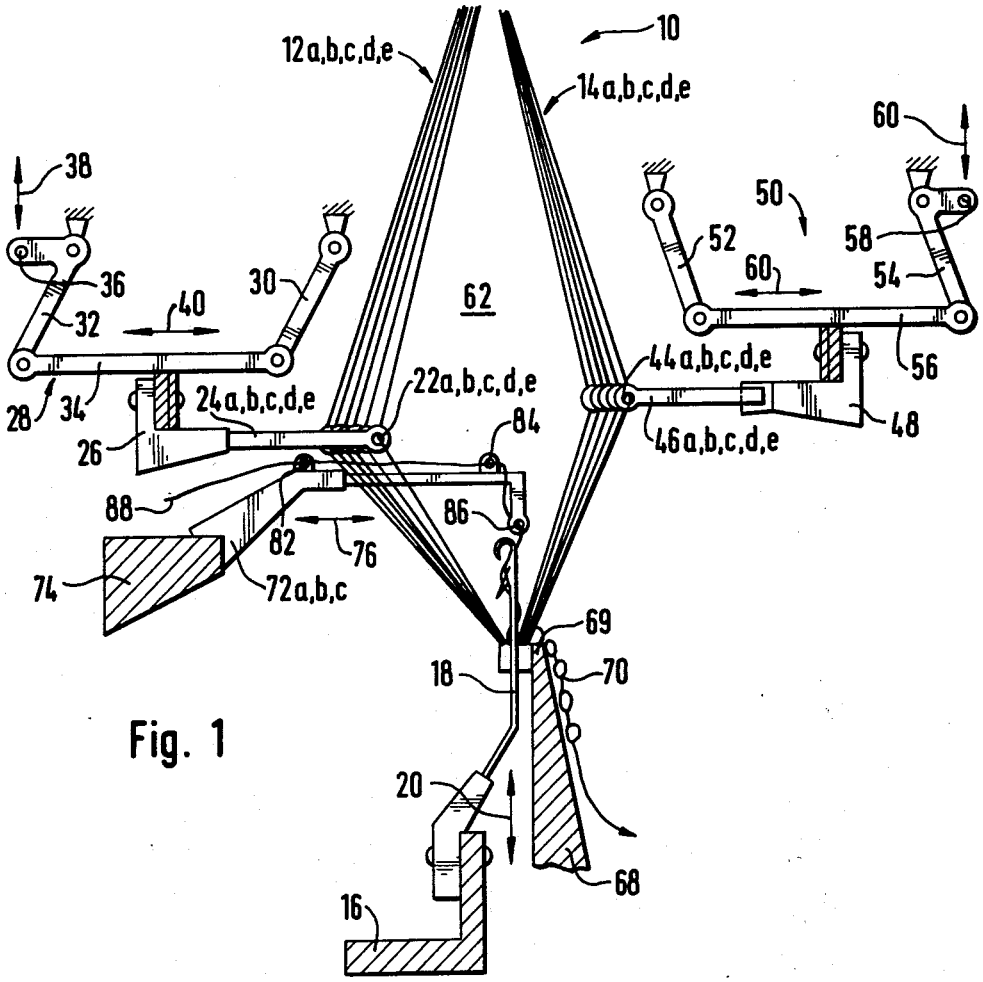
Fig. 1
Fig. 2
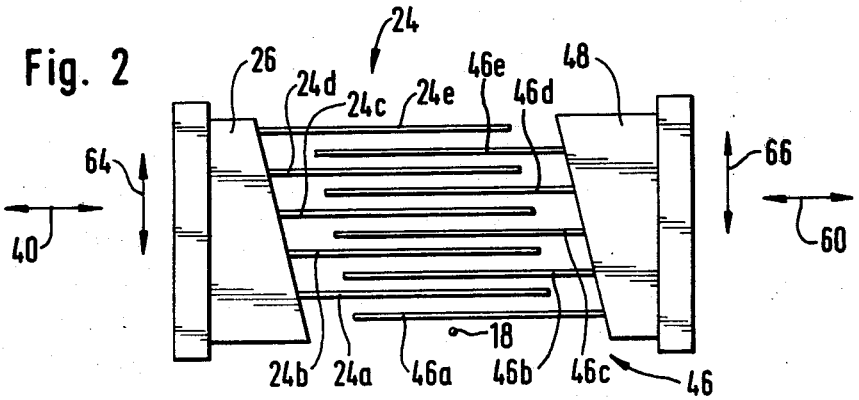

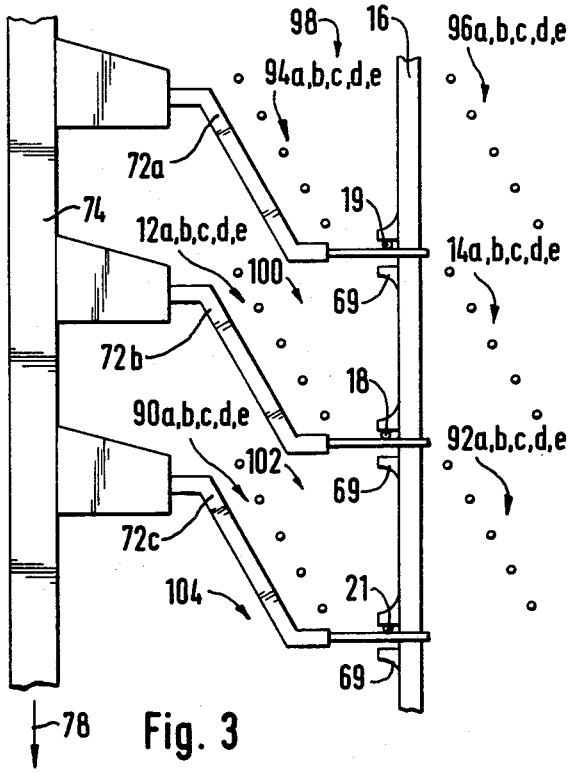
Fig. 3
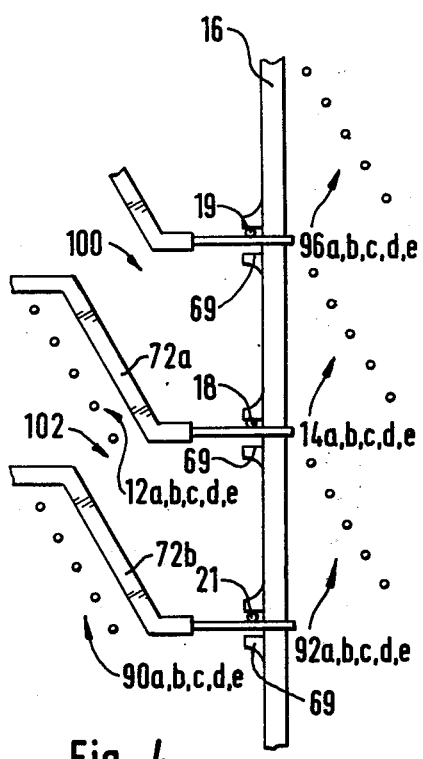
Fig. 4
Fig. 5
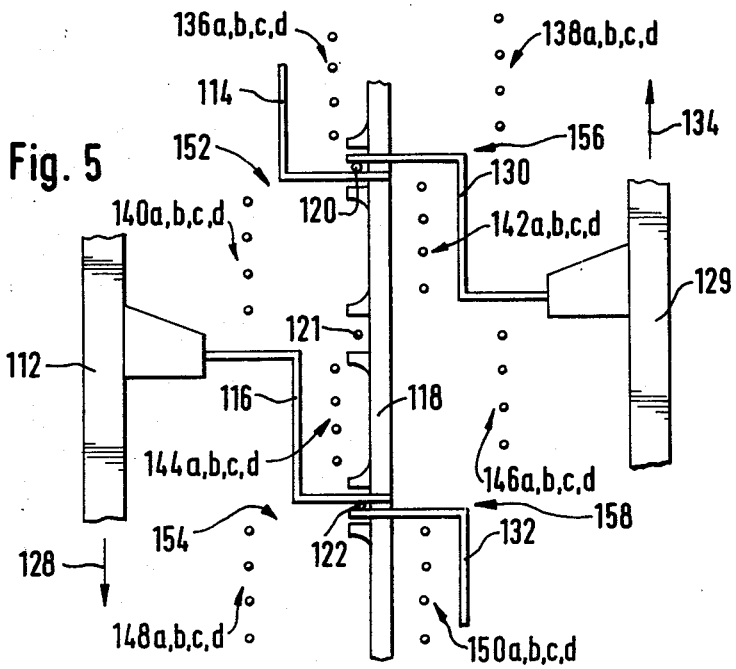

SHED FORMING WARP KNITTING MACHINE WITH WEFT INSERTERS

BACKGROUND OF THE INVENTION

The present invention relates to warp knitting machines and in particular to a warp knitting machine that is provided with a weft thread inserting device.

Prior art attempts at using a weft inserting device with a warp knitting machine have been very limited. Since the knitting needles are positioned relatively close together, the ability to cross over more than one or two warp threads has created insurmountable problems. The woven nature of the fabric produced with prior art techniques is interrupted by chain stitches occuring in very small strips. To overcome the basic problems it is necessary to device a means for installing a weft inserter into the relatively very narrow spacing between warp threads with the ability to work within the shed while being anchored outside the shed. It is also necessary to be able to span a relatively large number of warp threads and span at least two needles spaced relatively far apart.

The present invention overcomes the shortcomings of the prior art by reducing and virtually eliminating chain stitches which normally occur at narrow intervals across the width of the fabric thereby simulating the effect of woven fabric.

An object of the present invention is to provide a knitted fabric having an unusual characteristic.

Another object of the present invention is to provide a knitted fabric which has some of the features and characteristics of woven fabric.

Still another object of the present invention is to provide a means for knitting fabrics more rapidly and less expensively, with characteristics of woven cloth.

SUMMARY OF THE INVENTION

A warp knitting machine, according to the principles of the present invention, includes a needle bar with a plurality of needles affixed thereon, weft thread inserters, warp threads biased towards the needle bar, and a source of driving power, all of which are known in the art, and further includes the improvement which comprises; shed thread guides cooperating with the warp threads and alternately reciprocating groups of warp threads towards and away from the needles to form a shed with the needles disposed therein. The warp threads are provided with an enlarged opening between each of the groups. Weft thread inserters are angularly formed and disposed within the enlarged warp thread openings in close proximity to the needles. The weft thread inserters are driven to span at least a pair of said needles in addition to being reciprocated towards and away from said needles. A group of warp threads comprises from four to six warp threads displaced from the needles in one direction with a like number of warp threads displaced in the opposite direction forming the shed.

The above objects, as well as further objects and advantages of the present invention will become readily apparent after reading the description of a non-limiting illustrative embodiment and the accompanying drawing.

BRIEF DESCRIPTION OF THE DRAWINGS

In order that the invention may be more fully understood, it will now be described, by way of example, with reference to the drawing in which:

FIG. 1 is a partial sectional view and pictorial representation in elevation through the knitting portion of a warp knitting machine of a preferred embodiment, according to the principles of the present invention;

FIG. 2 is a partial plan view of the shed thread guides used in FIG. 1;

FIG. 3 is a partial plan view of the weft thread inserters disposed within the enlarged opening of each group of warp threads shown in FIG. 1;

FIG. 4 is a partial plan view of the system of FIG. 3 showing the position of the weft thread inserters within the enlarged opening and displaced in a lateral direction; and FIG. 5 is a partial plan view of an alternate embodiment of the present invention.

DESCRIPTION OF THE PREFERRED EMBODIMENTS

Referring now to the drawings, and particulary to FIG. 1, in which there is shown a partial view in section combined with a pictorial representation of the knitting portion 10 of a warp knitting machine. The warp threads 12 *a, b, c, d* and 14 *a, b, c, d* extend a vertical direction normally biased towards the needle bar 16 which has affixed thereon a plurality of needles 18 which are illustrated as being of the latching type. The needle bar 16 and needles 18 are driven by a conventional source of driving power, not shown, in a vertical direction (up and down) as shown by arrow 20 in accordance with the proper timed sequence.

The warp threads 12 *a, b, c, d, e* extend through the openings 22 *a, b, c, d, e* respectively, which are provided in the end portion of warp thread guides 24 *a, b, c, d, e.* The warp thread guides 24 *a, b, c, d, e* are affixed in a conventional manner to guide bar 26 which is connected to linkage mechanism 28 that includes the levers 30 and 32; and a connecting rod 34. The end 36 of the lever 32 is operatively coupled to the source of driving power and, displacing it in the direction of arrow 38 (vertical), will cause the connecting rod 34, the guide bar 26 and the warp thread guides 24 *a, b, c, d, e* to move in the direction of arrow 40, which is towards and away from the needles 18.

In a similar manner, warp threads 14 *a, b, c, d, e* extend through the openings 44 *a, b, c, d, e* respectively, which are provided in the end portion of warp thread guides 46 *a, b, c, d, e.* The warp thread guides 46 *a, b, c, d, e* are affixed in a conventional manner, to guide bar 48 which is connected to linkage mechanism 50 that includes the levers 52 and 54; and a connecting rod 56. The end 58 of the lever 54 is operatively coupled to the source of driving power and, displacing it in the direction of arrow 60 (vertical), will cause the connecting rod 56, the guide bar 48 and the warp thread guides 46 *a, b, c, d, e* to move in the direction of arrow 60, which is towards and away from the needles 18.

The movements of the guide bar 26 and the guide bar 48 are in opposite directions reciprocated, and synchronized with the other stitch forming mechanisms, in a conventional manner as is well known in the art. The guide bars, by their movement, displace the warp threads 12 *a, b, c, d, e,* and 14 *a, b, c, d, e* to form an opening 62 which extends in the lateral direction, in the same direction as the needle bar, and will be referred to hereinafter as the shed opening. The guide bars 26 and 48 and their associated warp thread guides 24 *a, b, c, d, e,* and 46 *a, b, c, d, e,* respectively, will be referred to hereinafter as the shed guides 24 and 46, respectively.

It can be seen that reciprocating the shed guides 24 and 46 towards the needles 18 and away therefrom will provide a shed opening 62 with the warp threads 12 *a, b, c, d, e* and 14 *a, b, c, d, e* alternately exchanging positions. Thus, warp threads 12 *a, b, c, d, e* are located, at one point in the cycle, in front of the needles 18, and 14 *a, b, c, d, e* are located behind the needles as shown in FIG. I. At the next lap, the former group of threads are located behind the needles and the latter in front of the needles with the needles always being disposed within shed 62.

It is important that the shed forming thread guides 24 and 46 are vertically separated as shown in FIG. 1 so that from the insertion of one weft to the next a new shed may be formed. In FIG. 1 as shown this shed is formed by threads 12 and 14. In this way a weft thread 88 is inserted. Then the shed changes. Thus the shed guides 24 go to the right hand side and the shed guides 46 go to the left hand side, so that then a new shed is formed with threads 14 on the left hand side and threads 12 on the right hand side and into this new shed weft threads 88 are inserted and so forth. This situation may be recognized from the plan drawing of FIG. 2 which shows the travel of 46 to the left and 24 to the right. FIG. 2 thus shows the reverse orientation of FIG. 4.

In the preferred embodiment of the invention, the shed 62 is formed by reciprocating a group of warp threads varying from four to six. However, it is to be understood that the present invention is not so limited and any number of warp threads may be reciprocated in accordance with the present invention.

FIG. 2 illustrates a plan view of the shed thread guides 24 and 46 in their most forward or closed position wherein FIG. 1 shows the shed thread guides in their most rearward open position; their direction of movement being indicated by arrows 40 and 60, respectively. In addition, shed thread guides 26 and 48 may be periodically moved in the direction of arrows 64 and 66, respectively, to permit the warp threads to lap or lay across the needles 18.

FIG. 1 further includes a sinker assembly 68 which holds the fabric 70 during the upward motion of the needles 18, to influence the lapping of the threads so that they arrive safely under the laches or heads of the needles, to push the previously formed row of stitches onto the closed needles and to cast them off over the new row of loops with the aid of the knockover edge 69 provided thereon.

In addition, FIG. 1 includes weft thread inserters 72 *a, b, c* which are affixed to bar 74, in a conventional manner. Weft bar 74 is driven from the source of driving power in synchronism with the other stitch forming mechanisms in the direction of arrow 76, and is also dirven in the direction of arrow 78 from its start position shown in FIG. 3 to its end position shown in FIG. 4. The weft bar 74 has affixed thereon, in a conventional manner, a weft thread inserter 80 which is provided with thread guide openings 82, 84, and 86 to guide the weft thread 88 to the needle 18.

Referring now to FIG. 3 wherein there is shown three groups of warp threads; 12 *a, b, c, d, e* and 14 *a, b, c, d, e;* 90 *a – e* and 92 *a – e;* and 94 *a – e* and 96 *a– e.* Each group is formed with two sets of fine warp threads angularly displaced with respect to the plane formed by the needles 18, 19 and 21. The warp threads are maintained in their correct position by their respective shed guides and explained hereinbefore. Between each group of weft threads an enlarged opening 98, 100, 102 and 104 is provided to permit the entrance therein of weft thread inserters.

Weft thread inserter 72*a* enters enlarged opening 100, inserter 72*b* enters enlarged opening 102, and inserter 72*c* enters enlarged opening 104. Moving weft bar 74 in the direction of arrow 78 permits the weft thread inserters 72*a* to move from a position proximate needle 19 to a position proximate needle 18 and weft thread inserter 72*b* to move from a position proximate needle 18 to needle 21, etc. (Refer to FIGS. 3 and 4). Thus with the arrangement set forth in the present invention each weft inserter may span a plurality of warp threads and span at least two needles which are located relatively far apart. Inserting weft threads may be done at various times in the knit cycle, thereby creating new, different and useful fabric types.

An alternate embodiment of the present invention is disclosed in FIG. 5. The alternate embodiment shown therein functions in the same manner as the preferred embodiment and includes a weft bar 112 which has affixed thereon weft thread inserters 114 and 116 positioned on one side (front) of the needle bar 118, which has needles 120, 121 and 122 affixed thereon, and weft thread inserters 124 and 126 positioned on the other side (rear) of the needle bar 118. Weft inserters 114 and 116 are adapted to be driven in the direction of arrow 128 and weft bar 129 which includes weft inserter 130 and 132 is adapted to be driven in the direction of arrow 134 in addition to being reciprocated towards and away from the needle bar 118.

The shed is formed, as described earlier, by the opening of the warp threads 136 *a – d* and 138 *a – d* in the first group; threads 140 *a – d* and 142 *a – d* in the second group; 144 *a – d* and 146 *a – d* in the third group and 148 *a – d* and 150 *a – d* in the fourth group. Each of the groups are separated by enlarged openings 152, 154, 156 and 158 which permit the weft inserters to enter the shed.

It is to be noted that the warp threads shown in FIGS. 3 and 4 are positioned by the warp thread guides at an angle to the needle bar 16 and that the central portion of the weft thread inserters 72 *a, b, c* are fabricated essentially parallel to the warp threads, thus permitting maximum movement in the direction of arrow 78 within the shed, thereby encompassing or spanning fine warp threads.

In the embodiment shown in FIG. 5 the central portion of the weft thread inserters 114, 116, 130 and 132 are also parallel to the warp threads and the warp threads are positioned in a plane parallel to the needle bar 118, thus also permitting maximum movement in the direction of arrow 128 for inserters 114 and 116; and in the direction of arrow 134 for inserters 130 and 132.

In operation, the weft inserters are driven in synchronism with the knitting mechanisms as is well known in the art and are able to insert one or more weft threads during knitting for unusual results.

Hereinbefore, has been disclosed a novel means for inserting a weft thread in a warp knitting machine which is capable of operating with needles spaced relatively large distances apart and spanning a relatively large number of weft threads.

It will be understood that various changes in the details, materials, arrangements of parts and operating conditions which have been herein described and illustrated in order to explain the nature of the invention may be made by those skilled in the art within the principles and scope of the present invention.

Having thus set forth the nature of the invention, what is claimed is:

1. In a warp knitting machine having a needle bar including a plurality of needles, weft thread inserters, shed thread guides and a source of driving power the improvement comprising:

a. providing said thread guides having eyelets in the heads thereof in pairs of sets, one set of each pair of sets being positioned on either side of the needle bed, the guides on each set on a given side of the needle bed lying substantially in a horizontal plane, the plane on a predetermined side of the needle bed being vertically separated from the plane on the other side of the needle bed by an amount at least sufficient to permit the guides in opposite sets of a predetermined pair to pass over each other, b. means for cyclically alternating the head portions of said thread guide from one side of the needle bed to the other side whereby warp threads passing through the eyelets of said guide form alternately the left and right, followed by the right and left side of a thread shed over the needle bed into which the weft thread inserters are insertable, said weft thread inserters being angularly formed and disposed between sets of shed thread guides in close proximity to said needles, said weft thread inserters being driven to span at least a pair of said needles in addition to being reciprocated towards and away from said needles.

2. A warp knitting machine according to claim 1 wherein each said group of warp threads comprises from four to six warp threads displaced from said needles in one direction with a like number of warp threads displaced in the opposite direction forming said shed.

3. A warp knitting machine in accordance with claim 1 wherein the eyelets of the guides in each set of a pair are oriented in a vertical plane substantially parallel to the needle bed and substantially parallel to a similar plane on the corresponding set of guides of the said pair on the other side of said needle bed, provided that where the guides on one side of the needle bed are at the position in the cycle most proximate to said needle bed the guides on the other side of said needle bed are at the point in the cycle most distant from the bed.

4. A warp knitting machine in accordance with claim 1 wherein the eyelets of the guides in each set of a pair are in a substantially vertical plane oriented towards the needle bed at one end of the said plane, the planes upon which the said eyelets lie on one side of the needle bed are mutually parallel with each other as well as with the planes on which the eyelets on the other side of the needle bed lie.

5. A warp knitting machine according to claim 1 wherein said weft thread inserters which cooperate with the warp threads on one side of the needle bar are disposed on that side of the needle bar and those weft thread inserters which cooperate with the warp threads on the other side of the needle bar are disposed on the other side of the needle bar.

6. A warp knitting machine according to claim 1 wherein said weft thread inserters are provided with a portion thereof disposed parallel with a plane formed by said group of warp threads.

* * * * *